US010902803B2

(12) United States Patent
Han et al.

(10) Patent No.: US 10,902,803 B2
(45) Date of Patent: Jan. 26, 2021

(54) DISPLAY PANEL, VOLTAGE ADJUSTMENT METHOD THEREOF, AND DISPLAY DEVICE

(71) Applicants: HEFEI BOE DISPLAY TECHNOLOGY CO. Ltd., Anhui (CN); BOE Technology Group Co., Ltd., Beijing (CN)

(72) Inventors: Yizhan Han, Beijing (CN); Shou Li, Beijing (CN); Liugang Zhou, Beijing (CN); Tao Li, Beijing (CN); Yulong Xiong, Beijing (CN); Jianwei Sun, Beijing (CN)

(73) Assignees: HEFEI BOE DISPLAY TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/479,764

(22) PCT Filed: Nov. 23, 2018

(86) PCT No.: PCT/CN2018/117306
§ 371 (c)(1),
(2) Date: Jul. 22, 2019

(87) PCT Pub. No.: WO2019/184407
PCT Pub. Date: Oct. 3, 2019

(65) Prior Publication Data

US 2020/0013354 A1 Jan. 9, 2020

(30) Foreign Application Priority Data

Mar. 29, 2018 (CN) ..... 2018 1 0271799

(51) Int. Cl.
*G09G 3/36* (2006.01)

(52) U.S. Cl.
CPC ..... *G09G 3/3611* (2013.01); *G09G 2310/08* (2013.01); *G09G 2320/0209* (2013.01);
(Continued)

(58) Field of Classification Search
CPC ..... G09G 3/3611
See application file for complete search history.

(56) References Cited

U.S. PATENT DOCUMENTS 8,274,457 B2 9/2012 Tsai
2004/0207329 A1* 10/2004 Kudo ..... G06F 1/3265 315/167

(Continued)

FOREIGN PATENT DOCUMENTS

CN 1682262 A 10/2005
CN 104157240 A 11/2014

(Continued)

OTHER PUBLICATIONS

Chinese Office Action dated Mar. 14, 2019 in related Chinese Application No. 201810271799.6.

*Primary Examiner* — Kevin M Nguyen
(74) *Attorney, Agent, or Firm* — Arent Fox LLP; Michael Fainberg

(57) ABSTRACT

The disclosure discloses a display panel, a voltage adjustment method thereof, and a display device, and the display panel includes: at least two reference sub-pixels; a voltage compensation element coupled respectively with respective reference sub-pixels; and a power management element coupled with the voltage compensation element, wherein the voltage compensation element is configured to acquire valid values of pixel voltage of the respective reference sub-pixels when the at least two reference sub-pixels receive the same data voltage, and to generate a compensation signal of gate off voltage for the purpose of making the acquired valid values of the pixel voltage of the respective reference (Continued)

sub-pixels uniform; and the power management element is configured to adjust a voltage value of the gate off voltage according to the compensation signal of the gate off voltage.

15 Claims, 7 Drawing Sheets

(52) U.S. Cl.
CPC ..... *G09G 2320/0233* (2013.01); *G09G 2330/021* (2013.01)

(56) References Cited

U.S. PATENT DOCUMENTS

| | | | | |
|---|---|---|---|---|
| 2005/0134534 | A1 | 6/2005 | Yamada et al. | |
| 2009/0237340 | A1* | 9/2009 | Park | G09G 3/2092 345/90 |
| 2011/0156611 | A1 | 6/2011 | Tsai | |
| 2016/0372049 | A1 | 12/2016 | Wang et al. | |
| 2018/0151136 | A1* | 5/2018 | Oh | G09G 3/3614 |
| 2019/0130830 | A1 | 5/2019 | Han | |

FOREIGN PATENT DOCUMENTS

| | | | |
|---|---|---|---|
| CN | 106128358 | A | 11/2016 |
| CN | 107749278 | A | 3/2018 |
| CN | 108648704 | A | 10/2018 |

* cited by examiner

DISPLAY PANEL, VOLTAGE ADJUSTMENT METHOD THEREOF, AND DISPLAY DEVICE

This application is a National Stage of International Application No. PCT/CN2018/117306, filed Nov. 23, 2018, which claims priority to Chinese Patent Application No. 201810271799.6, filed Mar. 29, 2018, both of which are hereby incorporated by reference in their entireties.

FIELD

This disclosure relates to the field of display technologies, and particularly to a display panel, a voltage adjustment method thereof, and a display device.

BACKGROUND

As the display technologies are advancing rapidly, there is a demand for display products with a larger size, a higher definition, and a better display effect. As the size and the resolution of a display product are improving, and a display module is evolving into being thinner and more lightweight, and being without any bezel, the problem that the quality of a displayed image is being degraded as ambient temperature is varying has become more pronounced primarily because operating characteristics of elements in the display product may slightly vary with temperature, and it is rather difficult to configure setting parameters taking into account all the varying temperature, before the display product was delivered from a factory, so a brightness non-uniformity (Mura) and a crosstalk may tend to occur at some temperature, thus seriously degrading the quality of the image on the display product.

SUMMARY

Embodiments of the disclosure provide a display panel including:

at least two reference sub-pixels;

a voltage compensation element coupled respectively with the at least two reference sub-pixels; and a power management element coupled with the voltage compensation element, wherein:

the voltage compensation element is configured to acquire valid values of pixel voltage of the respective reference sub-pixels when data voltage received by the at least two reference sub-pixels are the same, and to generate a compensation signal of gate off voltage for a purpose of making the acquired valid values of the pixel voltage of the respective reference sub-pixels uniform; and the power management element is configured to adjust a voltage value of the gate off voltage according to the compensation signal of the gate off voltage.

Optionally, in the embodiments of the disclosure, the display panel further includes a timing controller connected with the voltage compensation element, where the timing controller is configured to transmit a compensation enable signal to the voltage compensation element upon detecting that the data voltage received by the at least two reference sub-pixels are the same; and the voltage compensation element is configured to acquire the valid values of the pixel voltage of the respective reference sub-pixels in response to the compensation enable signal.

Optionally, in the embodiments of the disclosure, the voltage compensation element includes an acquiring sub-element and an analyzing sub-element, wherein:

the acquiring sub-element is configured to acquire the valid values of the pixel voltage of the respective reference sub-pixels;

the analyzing sub-element is configured to output the compensation signal to the power management element when a difference between valid values of pixel voltage of any two reference sub-pixels is above a preset threshold; and the power management element is configured to generate, according to the valid values of the pixel voltage of the respective reference sub-pixels acquired by the acquiring sub-element, a compensation and adjustment signal of the gate off voltage for making the valid values of the pixel voltage of the respective reference sub-pixels uniform in response to the compensation signal, and to adjust the voltage value of the gate off voltage according to the compensation and adjustment signal.

Optionally, in the embodiments of the disclosure, the analyzing sub-element includes an OR gate circuit and at least one subtracter circuit, wherein:

each of the at least one subtracter circuit has a first input terminal configured to receive a valid value of pixel voltage of one reference sub-pixel, a second input terminal configured to receive a valid value of pixel voltage of another reference sub-pixel, and an output terminal coupled with a first input terminal of the OR gate circuit; and the OR gate circuit has an output terminal coupled with the power management element and configured to output the compensation signal; and the preset threshold is a voltage value at a valid level of the OR gate circuit.

Optionally, in the embodiments of the disclosure, the power management element includes an initialization component, a determination component, a forward component, a backward component, and a voltage adjustment component, wherein:

the initialization component is configured to transmit a first compensation and adjustment signal to the voltage adjustment component in response to the compensation signal in a first compensation period after the compensation signal is received;

the determination component is configured to determine whether a difference parameter between the valid values of the pixel voltage of the respective reference sub-pixels in the current compensation period is increased or decreased with respect to that in a last compensation period at an end of any other compensation period than the first compensation period;

the forward component is configured to transmit one of the first compensation and adjustment signal and a second compensation and adjustment signal, which is the same as that transmitted in the last compensation period, to the power adjustment component upon determining that the difference parameter is decreased with respect to that in the last compensation period;

the backward component is configured to transmit one of the first compensation and adjustment signal and the second compensation and adjustment signal, which is different from that transmitted in the last compensation period, to the power adjustment component upon determining that the difference parameter is increased with respect to that in the last compensation period; and the voltage adjustment component is configured to lower the voltage value of the gate off voltage by one preset step in the next compensation period in response to the first compensation and adjustment signal, and to increase the voltage value of the gate off voltage by one preset step in the next compensation period in response to the second compensation and adjustment signal.

Optionally, in the embodiments of the disclosure, each compensation period is a display frame.

Optionally, in the embodiments of the disclosure, the respective reference sub-pixels are located in the same column.

Optionally, in the embodiments of the disclosure, the at least two reference sub-pixels include a first reference sub-pixel, a second reference sub-pixel, and a third reference sub-pixel, wherein:

the first reference sub-pixel and the third reference sub-pixel are located respectively at edges of a display area on two opposite sides thereof, and the second reference sub-pixel is located between the first reference sub-pixel and the third reference sub-pixel at equal distances from them.

Optionally, in the embodiments of the disclosure, the respective reference sub-pixels include pixel electrodes, and the display panel further includes connection lines corresponding to the respective reference sub-pixels in a one-to-one manner; and the pixel electrodes in the respective reference sub-pixels are coupled with the voltage compensation element through their corresponding connection lines.

Optionally, in the embodiments of the disclosure, polarities of pixel voltage of sub-pixels in two adjacent display frames are opposite.

Optionally, in the embodiments of the disclosure, the valid values of the pixel voltage of the respective reference sub-pixels are root mean squares of the pixel voltage of the respective reference sub-pixels in a display frame.

Correspondingly, the embodiments of the disclosure further provide a display device including the display panel according to the embodiments of the disclosure.

Correspondingly, the embodiments of the disclosure further provide a voltage adjustment method of the display panel according to the embodiments of the disclosure, the method including:

acquiring, by the voltage compensation element, the valid values of the pixel voltage of the respective reference sub-pixels when the data voltage received by the at least two reference sub-pixels are the same;

generating, by the voltage compensation element, the compensation signal of the gate off voltage for making the acquired valid values of the pixel voltage of the respective reference sub-pixels uniform; and adjusting, by the power management element, the voltage value of the gate off voltage according to the compensation signal of the gate off voltage.

Optionally, in the embodiments of the disclosure, generating the compensation signal of the gate off voltage for making the acquired valid values of the pixel voltage of the respective reference sub-pixels uniform includes:

outputting, by an analyzing sub-element, the compensation signal to the power management element when a difference between valid values of pixel voltage of any two of the reference sub-pixels is above a preset threshold; and adjusting the voltage value of the gate off voltage according to the compensation signal of the gate off voltage includes:

generating, by the power management element, according to the valid values of the pixel voltage of the respective reference sub-pixels acquired by the acquiring sub-element, a compensation and adjustment signal of the gate off voltage for making the valid values of the pixel voltage of the respective reference sub-pixels uniform, in response to the compensation signal; and adjusting the voltage value of the gate off voltage according to the compensation and adjustment signal.

Optionally, in the embodiments of the disclosure, generating the compensation and adjustment signal of the gate off voltage include:

transmitting, by an initialization component, a first compensation and adjustment signal to a voltage adjustment component in response to the compensation signal in a first compensation period after the compensation signal is received, and lowering, by the voltage adjustment component, the voltage value of the gate off voltage by one preset step in the next compensation period in response to the first compensation and adjustment signal;

determining whether a difference parameter between the valid values of the pixel voltage of the respective reference sub-pixels in the current compensation period is increased or decreased with respect to that in a last compensation period at an end of any other compensation period than the first compensation period;

transmitting one of the first compensation and adjustment signal and a second compensation and adjustment signal, which is the same as that transmitted in the last compensation period, to the power adjustment component upon determining that the difference parameter is decreased with respect to that in the last compensation period, wherein the power adjustment component lowers the voltage value of the gate off voltage by one preset step in the next compensation period in response to the first compensation and adjustment signal, and increases the voltage value of the gate off voltage by one preset step in the next compensation period in response to the second compensation and adjustment signal; and transmitting one of the first compensation and adjustment signal and the second compensation and adjustment signal, which is different from that transmitted in the last compensation period, to the power adjustment component upon determining that the difference parameter is increased with respect to that in the last compensation period.

BRIEF DESCRIPTION OF THE DRAWINGS

In order to make the technical solutions according to the embodiments of the disclosure more apparent, the drawings to which reference is to be made in the description of the embodiments will be introduced below in brief, and apparently the drawings to be described below illustrate only some embodiments of the disclosure, but appropriate variations of these drawings shall also fall into the claimed scope of the disclosure.

DETAILED DESCRIPTION OF THE EMBODIMENTS

In order to make the objects, technical solutions, and advantages of the disclosure more apparent, the embodiments of the disclosure will be described below in further details with reference to the drawings. Apparently the embodiments to be described are only a part but not all of the embodiments of the disclosure. Based upon the embodiments here of the disclosure, all of other embodiments which can occur to those ordinarily skilled in the art without any inventive effort shall come into the scope of the disclosure as claimed. Unless defined otherwise, technical terms or scientific terms throughout the disclosure shall convey their usual meaning as appreciated by those ordinarily skilled in the art to which the disclosure pertains. The terms "first", "second", or the like throughout the disclosure do not suggest any order, number or significance, but is only intended to distinguish different components from each other. Alike the terms "include", "comprise", or the like refer to that an element or an item preceding to the term encompasses an element(s) or an item(s) succeeding to the term, and its (or their) equivalence(s), but shall not preclude another element(s) or item(s). The terms "connect", "couple", "connected", or the like do not suggest physical or mechanical connection, but may include electrical connection no matter whether it is direct or indirect.

A display panel can include sub-pixels in rows by columns, a plurality of gate lines and a plurality of data lines, where a row of sub-pixels corresponds to a gate line, and a column of sub-pixels corresponds to a data line. Each sub-pixel can include a Thin Film Transistor (TFT) and a pixel electrode, where the thin film transistor has a gate coupled with a gate line corresponding to a row of sub-pixels including the sub-pixel, a source coupled with a data line corresponding to a column of sub-pixels including the sub-pixel, and a drain coupled with the pixel electrode in the sub-pixel. When voltage on a gate line is a gate on voltage, thin film transistors coupled with the gate line can be controlled to be turned on to write data voltage on data lines into pixel electrodes through source-drain current in the thin film transistors so that pixel voltage on the pixel electrodes corresponds to the data voltage. When voltage on a gate line is a gate off voltage, thin film transistors coupled with the gate line can be controlled to be turned off, and at this time, there is so small source-drain current in the thin film transistors that data voltage on data lines, and pixel voltage on pixel electrodes will substantially not affect each other. Accordingly, the gate on voltage and the gate off voltage are used respectively for controlling the thin film transistors to be turned on and off, and voltage values thereof can be adjusted in a possible range, and may affect operating states of the thin film transistors in respective sub-pixels Px.

Figure 1:
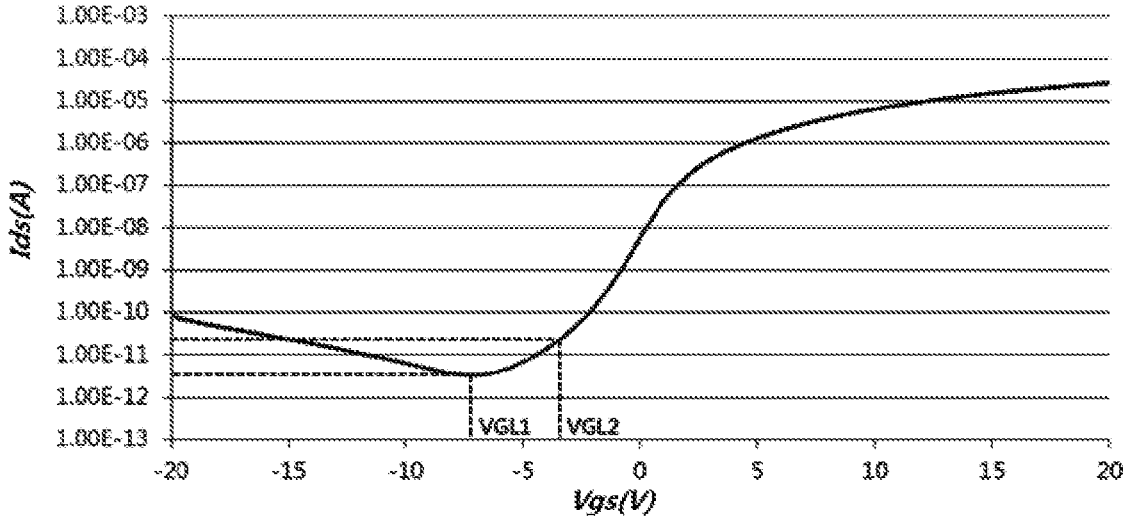
FIG. 1 is a transfer characteristic curve of a thin film transistor according to the embodiments of the disclosure.

FIG. 1 is a transfer characteristic curve of a thin film transistor according to the embodiments of the disclosure. In FIG. 1, a source-drain current (Ids) when a gate-source voltage (Vgs) of the thin film transistor is equal to VGL1 is smaller than the source-drain current (Ids) when the gate-source voltage (Vgs) is equal to VGL2, where VLG1 and VGL2 are respectively two voltage values of a gate off voltage VGL. And by taking a source voltage of the thin film transistor as 0V, a gate voltage of the thin film transistor which is turned off is equal to a voltage value of VGL; and at this time, the source-drain current (referred to leakage current) of the thin film transistor may vary in a certain range with different VGL. In the example above, a pixel voltage on a pixel electrode may drop gradually over time due to the leakage current, and accordingly a displayed image will disappear, thus resulting in a poor display effect of the image. Thus, in order to reduce the leakage current, it is preferable to set the voltage value of VGL at VGL1 than VGL2 in FIG. 1.

However, there may be generally different characteristics of different thin film transistors in the same display panel, and the characteristics of the thin film transistors may also vary with temperature or another ambient condition, thus the uniformity of the displayed image may be affected by both the leakage current and the other factor. For example, when the display panel is in a high-temperature environment, the characteristics of the thin film transistors will vary, and the characteristics of the thin film transistors in different areas of the display panel may vary differently so that there is different leakage current of the thin film transistors in the different areas of the display panel. In this way, when a monochromatic image, e.g., a white image, is being displayed, there may be different brightness at different sub-pixels due to the different characteristics and leakage current of the different thin film transistors, thus degrading the uniformity of the displayed image.

In the related art, it is generally believed that the problem above arises directly from varying temperature of the display panel, and thus is addressed by compensating for the temperature, that is, the temperature of a circuit board outside the display area of the display panel is detected in real time, and respective electric signals provided to the sub-pixels are adjusted according to a change in temperature so that the characteristics of the thin film transistors can be adapted to the temperature. However the temperature outside the display area can neither exactly represent the temperature of the thin film transistors, nor reflect the differences in temperature between the different areas, and it is also very difficult to determine accurately the corresponding total characteristics of the thin film transistors in the respective temperature ranges, so there is a very limited effect of compensating for the temperature in this way.

Hereupon, the embodiments of the disclosure provide a display panel which can improve the image quality and the reliability of a display product.

Figure 2:
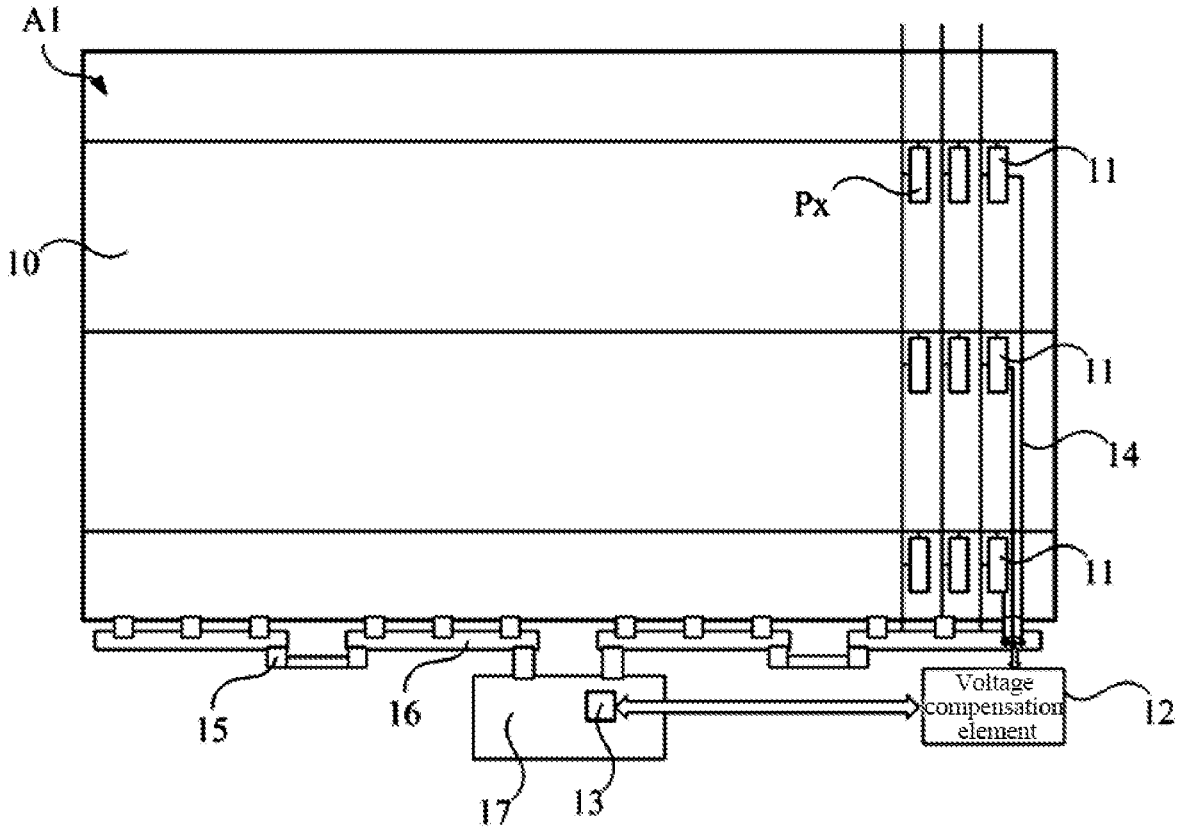
FIG. 2 is a schematic structural diagram of a display panel according to the embodiments of the disclosure.

FIG. 2 is a schematic structural diagram of a display panel according to the embodiments of the disclosure. The display panel includes at least two reference sub-pixels 11 (e.g., three reference sub-pixels as illustrated here). In addition to this, the display panel further includes a voltage compensation element 12 coupled respectively with respective reference sub-pixels 11, and a power management element 13 coupled with the voltage compensation element 12; where the voltage compensation element 12 is configured to acquire valid values of pixel voltage of the respective reference sub-pixels 11 when data voltage received by the at least two reference sub-pixels 11 are the same, and to generate a compensation signal of a gate off voltage for a purpose of making the acquired valid values of the pixel voltage of the respective reference sub-pixels 11 uniform; and the power management element 13 is configured to adjust a voltage value of the gate off voltage according to the compensation signal of the gate off voltage.

In the display panel according to the embodiments of the disclosure, the voltage compensation element and the power management element are arranged, and the at least two reference sub-pixels are arranged among a plurality of sub-pixels, where the voltage compensation element acquires the valid values of the pixel voltage of the at least two reference sub-pixels receiving the same data voltage to reflect a difference in brightness between the different sub-pixels in a display area, and also the voltage compensation element adjusts the voltage value of the gate off voltage for making the valid values of the pixel voltage uniform, i.e. for making the brightness uniform, so that the characteristics of the thin film transistors can vary in such a way to make their brightness uniform as a whole. As compared with the temperature compensation approach in the related art, the brightness can be made uniform as a whole through a new compensation approach in the embodiments of the disclosure to thereby alleviate the uniformity of brightness from dropping due to the varying temperature in the display product. Furthermore, the uniformity of brightness can also be alleviated from dropping due to the other factors to thereby improve the image quality and the reliability of a display product.

Figure 3:
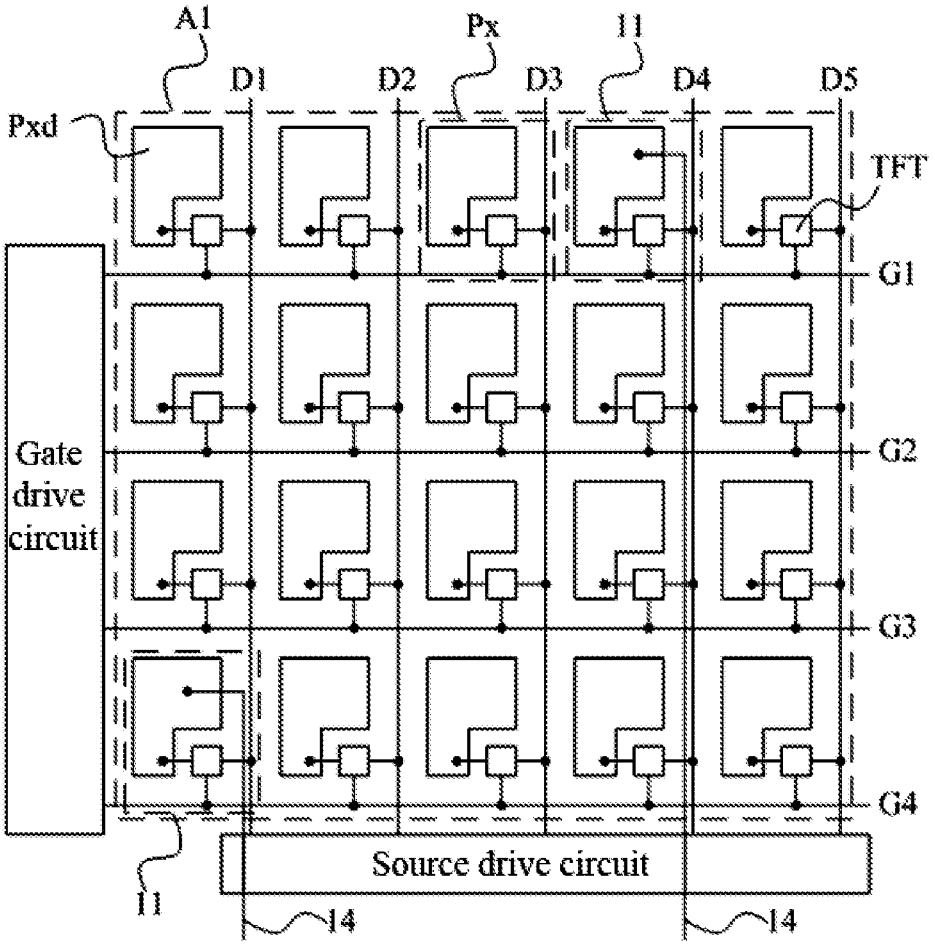
FIG. 3 is a schematic structural diagram of a display area of a display panel according to the embodiments of the disclosure.

In a practical implementation, in order to display an image, as illustrated in FIG. 2 and FIG. 3, a display panel can include a plurality of sub-pixels Px (e.g., nine sub-pixels Px thereof are illustrated in FIG. 2 for the sake of clarity) arranged in rows by columns in a display area A1 so that at least two reference sub-pixels can be arranged among the sub-pixels Px. The display panel can further include a plurality of gate lines G1 to G4 (only four gate lines as illustrated, for example), and a plurality of data lines D1 to D5 (only five data lines as illustrated, for example), where a row of sub-pixels corresponds to a gate line, and a column of sub-pixels corresponds to a data line. And each sub-pixel Px can include a Thin Film Transistor (TFT) and a pixel electrode Pxd, where the thin film transistor has a gate coupled with a gate line corresponding to a row of sub-pixels including the sub-pixel Px, a source coupled with a data line corresponding to a column of sub-pixels including the sub-pixel Px, and a drain coupled with the pixel electrode Pxd in the sub-pixel Px. In a practical application, when the TFT is an N-type transistor, the gate on voltage is a gate voltage at a high level VGH, and the gate off voltage is a gate voltage at a low level VGL. In this way, VGH and VGL are used respectively for controlling the thin film transistor to be turned on and off, and their voltage values may be adjusted in a possible range, and may affect operating states of the thin film transistors in the respective sub-pixels Px.

It shall be noted that, in the embodiments of the disclosure, a pixel voltage refers to a voltage, on a pixel electrode in a sub-pixel Px, corresponding to a grayscale presented by the sub-pixel while an image is being displayed, e.g., a voltage on a pixel electrode in a sub-pixel of a liquid crystal display panel (an electric field between a pixel electrode in each sub-pixel, and a common electrode is applied to liquid crystal molecules at a liquid crystal layer to thereby adjust the transmittance of the liquid crystal layer, where there is a constant common voltage on the common electrode in a display state); a data voltage refers to a voltage provided to a sub-pixel from the outside so that there is a pixel voltage of a desirable value on a pixel electrode in the sub-pixel; and a valid value of a pixel voltage of a reference sub-pixel refers to a Root Mean Square (RMS) of the pixel voltage of the reference sub-pixel in a display period, where the display period can be a display frame, for example.

As can be appreciated, if the valid values of the pixel voltage of the respective reference sub-pixels 11 are kept uniform for a period of time, then the pixel voltage provided to the respective reference sub-pixels 11 will be considered as satisfying the uniformity requirement on a displayed image. Hereupon, if the selected reference sub-pixels 11 are sufficient to represent the respective sub-pixels in the whole display area A1, then it can be considered that the pixel voltage provided to each sub-pixel 11 satisfies the uniformity requirement on a displayed image. Where the uniformity of a displayed image can be reflected by a difference in brightness between different sub-pixels at the same grayscale, for example.

FIG. 3 is a schematic structural diagram of a display area of a display panel according to the embodiments of the disclosure. In FIG. 3, a Thin Film Transistor (TFT) in each sub-pixel Px has a gate coupled with a gate line G1 or G2 or G3 or G4 corresponding to a row of sub-pixels including the sub-pixel Px, a source coupled with a data line D1 or D2 or D3 or D4 corresponding to a column of sub-pixels including the sub-pixel Px, and a drain coupled with a pixel electrode Pxd in the sub-pixel Px. The display panel can further include connection lines 14 corresponding to respective reference sub-pixels 11 in a one-to-one manner, where pixel electrodes Pxd in the respective reference sub-pixels 11 are coupled with a voltage compensation element 12 through their corresponding connection lines 14. The sub-pixels Px as illustrated in FIG. 3 include two reference sub-pixels 11, and a pixel electrode Pxd in each reference sub-pixel 11 is connected to the outside of the display area A1 through one corresponding connection line 14. Comparing FIG. 2 with FIG. 3, a source drive circuit connected with all the data lines as illustrated in FIG. 3 is arranged on a data circuit board 16 as illustrated in FIG. 2, and a gate drive circuit connected with all the gate lines as illustrated in FIG. 3 is arranged on a substrate 10 as illustrated in FIG. 2. Furthermore, in a practical implementation, the reference sub-pixels can include a first reference sub-pixel, a second reference sub-pixel, and a third reference sub-pixel, where the first reference sub-pixel and the third reference sub-pixel can be located respectively at edges of the display area on two opposite sides thereof, and the second reference sub-pixel can be located between the first reference sub-pixel and the third reference sub-pixel at equal distances from them. For example, apparently two reference sub-pixels 11 (i.e., the first reference sub-pixel and the third reference sub-pixel) in FIG. 3 are located respectively at the edges of the display area A1 on two opposites thereof, two reference sub-pixels 11 (i.e., the first reference sub-pixel and the third reference sub-pixel) among the three reference sub-pixels 11 in FIG. 2 are located respectively at the edges of the display area A1 on two opposite sides thereof, and the other reference sub-pixel 11 (i.e., the second reference sub-pixel) is located between these two reference sub-pixels 11 at equal distances from them. For example, the three reference sub-pixels 11 in FIG. 2 are located respectively at ⅙, ½, and ⅚ of the total number of rows.

Furthermore, the respective reference sub-pixels can be located in the same column. For example, the three reference sub-pixels 11 in FIG. 2 are located in the same column, that is, all the pixel electrodes of these three reference sub-pixels 11 are connected with the same data line, and these three reference sub-pixels are sub-pixels in the same color (e.g., blue) in a display panel of an RGB type. It shall be further appreciated that, all the reference sub-pixels are located in the same column of sub-pixels as illustrated in FIG. 2, so it is easier to route the connection lines by converging them at a connection port at an edge of the substrate 10 to thereby simplify wiring in the circuit. Furthermore, there is approximate leakage current at respective sub-pixels in the same row of sub-pixels, so any two reference sub-pixels among the at least two reference sub-pixels in the display panel can be located respectively in two different rows of sub-pixels.

It shall be appreciated that, the reference sub-pixels in the embodiments of the disclosure are such sub-pixels among the plurality of sub-pixels in the display area that are reference samples, so a larger number of reference sub-pixels at a higher density in a larger coverage area can be arranged as required for improving the accuracy and reliability of compensation, or a smaller number of reference sub-pixels can be arranged as required for saving a layout space, and lowering the complexity of the circuit, although the embodiments of the disclosure will not be limited thereto.

It shall be further appreciated that, FIG. 2 illustrates an example of a connection pattern between the reference sub-pixels and the voltage compensation element according to the embodiments of the disclosure. As illustrated in FIG. 2, the three reference sub-pixels arranged at the very edge (for example, the pixel electrodes can be connected) are connected respectively to the outside of the display area A1 through their respective connection lines 14, and connected with three contacts on a data circuit board 16 through a Flexible Printed Circuit (FPC) 15 at the edge of the substrate 10, so that the voltage compensation element 12 arranged on or externally connected with the data circuit board 16 can be connected respectively with these three reference sub-pixels 11. Moreover, respective data circuit boards 16 are connected with circuit structures on the substrate 10 through flexible printed circuits 15, and each data circuit board 16 can be connected with a main circuit board 17 of the display panel through a circuit board with a connecting function, where the power management element 13 is arranged on the main circuit board 17. When the voltage compensation element 12 is arranged on the rightmost data circuit board 16, the voltage compensation element 12 can be connected with the power management element 13 on the main circuit board 17 through electrical connections between the circuit boards. When the voltage compensation element 12 is arranged separate from the respective circuit boards, the voltage compensation element 12 can be wired directly with the power management element 13 on the main circuit board 17. Of course, the voltage compensation element 12 can alternatively be connected wirelessly with the power management element 13, for example, through near-field or optical communication, although the embodiments of the disclosure will not be limited thereto.

Figure 4:
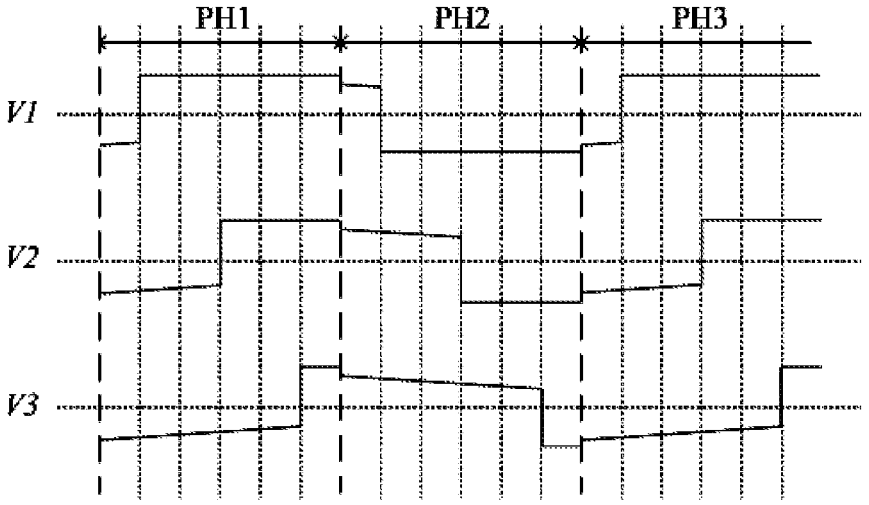
FIG. 4 is a schematic diagram of varying pixel voltage according to the embodiments of the disclosure.

FIG. 4 is a schematic diagram of varying pixel voltage according to the embodiments of the disclosure. FIG. 4 illustrates varying pixel voltage V1, V2, and V3 corresponding to three sub-pixels in three consecutive display frames PH1, PH2, and PH3. As can be apparent, a frame inversion mode in polarity reverse modes is adopted in this example, so there are opposite polarities of pixel voltage of a plurality of sub-pixels in the display area, in two adjacent display frames. The polarities of data voltage on all the data lines are inverted at the beginning of each display frame, so there is significant reverse leakage current in the thin film transistors due to an increase in gate-source voltage. However, the length of time from the beginning of reverse leakage to writing of data voltage in the current frame varies from one sub-pixel to another, so even if there is the same voltage value of the data voltage written into the three sub-pixels, there will be lower brightness of a sub-pixel with a larger length of time for reverse leakage, thus degrading the uniformity of brightness of the display panel. In view of this problem, in the technical solution according to the embodiments of the disclosure, the voltage value of the gate off voltage can be adjusted to thereby make the valid values of the pixel voltage uniform, so operating states of the thin film transistors can be adjusted to reduce the reverse leakage current to thereby alleviate the brightness from becoming non-uniform due to the reverse leakage so as to improve the quality of an image on the display product, and the reliability thereof.

Figure 5:
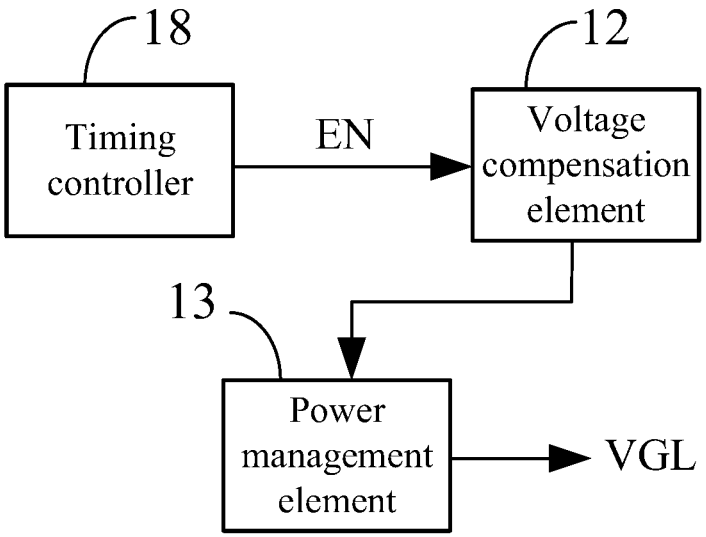
FIG. 5 is a schematic principle diagram of voltage adjustment and compensation according to the embodiments of the disclosure.

FIG. 5 is a schematic principle diagram of voltage compensation according to the embodiments of the disclosure. In FIG. 5, the display panel further includes a timing controller 18 connected with the voltage compensation element 12, where the timing controller 18 is configured to transmit a compensation enable signal EN to the voltage compensation element 12 upon detecting that data voltage received by the at least two reference sub-pixels are the same. Furthermore, the voltage compensation element 12 is configured to acquire the valid values of the pixel voltage of the respective reference sub-pixels in response to the compensation enable signal EN. In some embodiments, the timing controller 18 is arranged on the main circuit board 17, and configured to control output time sequences of the gate drive circuit and the source drive circuit based upon received display data. The timing controller 18 can obtain data information of a displayed image, and further send the compensation enable signal EN to the voltage compensation element 12 upon detecting that data voltage received by all the sub-pixels are the same (for example, the current image is a white image, and all the data voltage is a data voltage at the highest grayscale) so that the voltage compensation element 12 acquires the valid values of the pixel voltage of the respective reference sub-pixels, and generates the compensation signal of the gate off voltage based upon those valid values. In this way, the power management element 13 generates a first compensation and adjustment signal v− and/or a second compensation and adjustment signal v+ of the gate off voltage for making the valid values of the pixel voltage of the respective reference sub-pixels uniform, according to the compensation signal of the gate off voltage generated by the voltage compensation element 12, and the valid values of the pixel voltage of the respective reference sub-pixels acquired by the voltage compensation element 12, and adjusts a value of output voltage of VGL according to the first compensation and adjustment signal v− and/or the second compensation and adjustment signal v+.

Here the first compensation and adjustment signal v− is configured to control the power management element 13 to lower the output voltage value of the gate off voltage by one preset step in a next compensation period, and the second compensation and adjustment signal v+ is configured to control the power management element 13 to increase the output voltage value of the gate off voltage by one preset step in the next compensation period. In some embodiments, the power management element 13 can generate the first compensation and adjustment signal v− or the second compensation and adjustment signal v+ according to the valid values acquired in a display frame, so upon reception of the first compensation and adjustment signal v− in a display frame, the power management element 13 can lower an original voltage value of the gate off voltage to be output by one preset step in the next display frame, and upon reception of the second compensation and adjustment signal v+ in a display frame, the power management element 13 can increase the original voltage value of the gate off voltage to be output by one preset step in the next display frame. Of course, the power management element 13 can adjust the voltage value of the gate off voltage by a magnitude from −10V to 1V to thereby avoid an adverse influence of a too large or too small voltage value of the gate off voltage.

In some embodiments, the power management element 13 can adjust the output voltage value of the gate off voltage by the smallest magnitude of 0.1V in a range of −14V to −4V, so the voltage value of the gate off voltage can be adjusted and compensated for using 0.1V as the preset step above. For example, the power management element 13 outputs the voltage value −3V of the gate off voltage in a display frame, and generates the first compensation and adjustment signal v− in the display frame, so the power management element 13 can adjust the voltage value of the gate off voltage to be output in the next display frame to −3.1V in the range above, and apply the adjusted gate off voltage in the next display frame, so that the gate off voltage is −3.1V in the next display frame. In another example, the power management element 13 outputs the voltage value −7.3V of the gate off voltage in a display frame, and generates the second compensation and adjustment signal v+ in the display frame, so the power management element 13 can adjust the voltage value of the gate off voltage to be output in the next display frame to −7.2V in the range above, and apply the adjusted gate off voltage in the next display frame, so that the gate off voltage is −7.2V in the next display frame.

As can be appreciated, the compensation period in this example can be a display frame; and in each compensation period, the voltage compensation element 12 acquires the valid values of the pixel voltage of the reference sub-pixels 11, and outputs the compensation signal based upon the valid values, and the power management element 13 adjusts the output voltage value of the gate off voltage in the next compensation period based upon the compensation signal received in any compensation period. Moreover, the timing controller 18 can control the voltage compensation element 12 according to the compensation enable signal EN to or not to acquire the valid values and output the compensation signal as described above, so that the compensation operation of the voltage compensation element 12 can be stopped automatically when such a compensation condition is not satisfied that the reference sub-pixels 11 receive the same data voltage, to thereby lower power consumption. In this way, after the voltage compensation element 12 is stopped from operating, the power management element 13 can maintain the lastly adjusted gate off voltage, and continue with outputting the voltage value of the gate off voltage in the last compensation period, and thereafter the display panel will operate with the compensated gate off voltage accordingly.

In some embodiments, the voltage compensation element can include an acquiring sub-element and an analyzing sub-element, where the acquiring sub-element is configured to acquire the valid values of the pixel voltage of the respective reference sub-pixels, and the analyzing sub-element is configured to output a compensation and adjustment signal to the power management element when a difference between valid values of pixel voltage of any two reference sub-pixels is above a preset threshold. In this way, the power management element can be configured to generate, according to the valid values of the pixel voltage of the respective reference sub-pixels acquired by the acquiring sub-element, the compensation and adjustment signal of the gate off voltage for making the valid values of the pixel voltage of the respective reference sub-pixels uniform, in response to the compensation signal, and to adjust the voltage value of the gate off voltage according to the compensation and adjustment signal.

It shall be noted that, the acquiring sub-element can be embodied like a detection circuit of a valid value of voltage in the related art, and for example, a true valid value measurement circuit can directly measure true valid values of pixel voltage of sub-pixels connected therewith, or the pixel voltage can be sampled and then a square root of a squared sum thereof can be calculated, although the embodiments of the disclosure will not be limited thereto.

In a practical implementation, the analyzing sub-element can include an OR gate circuit and at least one subtracter circuit, where each subtracter circuit has a first input terminal configured to receive a valid value of pixel voltage of a reference sub-pixel, a second input terminal configured to receive a valid value of pixel voltage of another reference sub-pixel, and an output terminal coupled with a first input terminal of the OR gate circuit; and an output terminal of the OR gate circuit is coupled with the power management element, and configured to output the compensation signal; where the preset threshold is a valid level voltage value of the OR gate circuit. Further, the analyzing sub-element can include an OR gate circuit and one or two subtracter circuits as needed in a practical application environment, although the embodiments of the disclosure will not be limited thereto.

Figure 6:
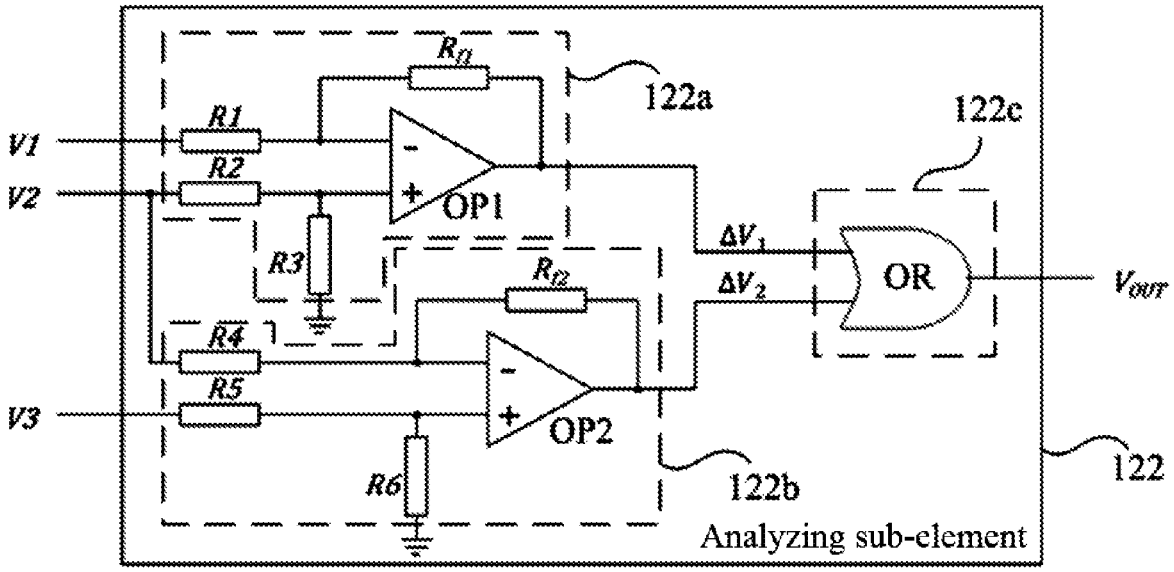
FIG. 6 is a schematic circuit structural diagram of an analyzing sub-element according to the embodiments of the disclosure.

FIG. 6 is a schematic circuit structural diagram of the analyzing sub-element according to the embodiments of the disclosure. In FIG. 6, the analyzing sub-element can include a subtracter circuit 122*a*, a subtracter circuit 122*b*, and an OR gate circuit 122*c*, and there are three configured reference sub-pixels. Based upon valid values V1, V2, and V3 of pixel voltage of the three reference sub-pixels acquired by the acquiring sub-element, an output of the analyzing sub-element is configured as a logic level VOUT, i.e., a compensation signal, for controlling the power management element to or not to operate. Particularly, the subtracter circuit 122*a* includes an operational amplifier OP1, resistors R1, R2, R3, and $R_{f1}$; where a first terminal of the resistor R1, which is a first input terminal of the subtracter circuit 122*a*, is configured to receive the valid value V1 of the pixel voltage of the first reference sub-pixel, and a second terminal of the resistor R1 is coupled with a negative input terminal of the operational amplifier OP1; a first terminal of the resistor R2, which is a second input terminal of the subtracter circuit 122*a*, is configured to receive the valid value V2 of the pixel voltage of the second reference sub-pixel, and a second terminal of the resistor R2 is coupled with a positive input terminal of the operational amplifier OP1; a first terminal of the resistor R3 is grounded, and a second terminal of the resistor R3 is coupled with the positive input terminal of the operational amplifier OP1; a first terminal of the resistor $R_{f1}$ is coupled with the negative input terminal of the operational amplifier OP1, and a second terminal of the resistor $R_{f1}$ is coupled with an output terminal of the operational amplifier OP1; and the output terminal of the operational amplifier OP1 is coupled with a first input terminal of the OR gate circuit 122*c*.

The subtracter circuit 122*b* includes an operational amplifier OP2, resistors R4, R5, R6, and $R_{f2}$; where a first terminal of the resistor R4, which is a first input terminal of the subtracter circuit 122*b*, is configured to receive the valid value V2 of the pixel voltage of the second reference sub-pixel, and a second terminal of the resistor R4 is coupled with a negative input terminal of the operational amplifier OP2; a first terminal of the resistor R5, which is a second input terminal of the subtracter circuit 122*b*, is configured to receive the valid value V3 of the pixel voltage of the third reference sub-pixel, and a second terminal of the resistor R5 is coupled with a positive input terminal of the operational amplifier OP2; a first terminal of the resistor R6 is grounded, and a second terminal of the resistor R6 is coupled with the positive input terminal of the operational amplifier OP2; a first terminal of the resistor $R_{f2}$ is coupled with the negative input terminal of the operational amplifier OP2, and a second terminal of the resistor $R_{f2}$ is coupled with an output terminal of the operational amplifier OP2; and the output terminal of the operational amplifier OP2 is coupled with a second input terminal of the OR gate circuit 122*c*.

The OR gate circuit 122*c* includes a two-input OR gate, where the OR gate has a first input terminal which is the first input terminal of the OR gate circuit 122*c*, a second input terminal which is the second input terminal of the OR gate circuit 122*c*, and an output terminal which is an output terminal of the OR gate circuit 122*c*.

In some embodiments, a resistance r1 of the resistor R1 can be set equal to a resistance r2 of the resistor R2, that is, r1=r2. A resistance r3 of the resistor R3 can be set equal to a resistance rf1 of the resistor $R_{f1}$, that is, r3=rf1. A resistance r4 of the resistor R4 can be set equal to a resistance r5 of the resistor R5, that is, r4=r5. A resistance r6 of the resistor R6 can be set equal to a resistance rf2 of the resistor $R_{f2}$, that is r6=rf2. Furthermore, an output of the operational amplifier OP1 is $\Delta V1=(rf1/r1)(V1-V2)$, and an output of the operational amplifier OP2 is $\Delta V2=(rf2/r4)(V2-V3)$. The values of rf1/r1 and rf2/r4 can be set so that ΔV1 lies in a range of high-level voltage at the input terminal of the OR gate when V1−V2 is above a preset threshold, and lies in a range of low-level voltage at the input terminal of the OR gate when V1−V2 is below the preset threshold, and ΔV2 lies in the range of high-level voltage at the input terminal of the OR gate when V2−V3 is above the preset threshold, and lies in the range of low-level voltage at the input terminal of the OR gate when V2−V3 is below the preset threshold. In this way, the logical level VOUT can be generated without any analog to digital conversion circuit to thereby further simplify the circuit structure. In a practical implementation, the preset threshold can be set as needed in a real application environment, although the embodiments of the disclosure will not be limited thereto.

By way of an example, the display panel including a plurality of reference sub-pixels can be arranged with a multi-input OR gate circuit, and a plurality of subtracter circuits, each of which has an output terminal connected with one of input terminals of the OR gate circuit, where each subtracter circuit is configured to receive valid values of pixel voltage of two reference sub-pixels, and to transmit a difference between the two valid values to the OR gate circuit, and the OR gate circuit is configured to switch the compensating sub-element to an operating state when any one of the received differences is above the preset threshold. It shall be noted that, the analyzing sub-element can calculate the differences between the valid values of the pixel voltage of any two of the reference sub-pixels, or can calculate only a part thereof, as needed in a practical application.

Hereupon a subtracter circuit can be arranged to input a difference to an input terminal of the OR gate circuit in the form of a voltage signal, where a voltage value of the voltage signal corresponding to the difference above the preset threshold lies in a range of valid level voltage (e.g., high-level voltage) at the input terminal of the OR gate circuit, and a voltage value of the voltage signal corresponding to the difference below the preset threshold lies out of the range of valid level voltage (e.g., low-level voltage) at the input terminal of the OR gate circuit, so that the OR gate circuit outputs a compensation signal at a valid level, e.g., a compensation signal at the high level, when a voltage value at any one of the input terminals thereof lies out of the range of valid level voltage. In this way, a level at a switch control terminal of the power management element can be set to a valid level so that the power management element is switched to an operating state. It shall be noted that, the valid and invalid levels in this context refer two different pre-configured voltage ranges respectively for a specific circuit node (with reference to voltage at a common terminal). As can be appreciated, there is an output at a high level when there is a high level at any one or more of the input terminals under the rule of the OR operation. In this way, the valid levels at the input terminals of the OR gate circuit can be matched using proportional magnification in the subtracter circuits.

Figure 7:
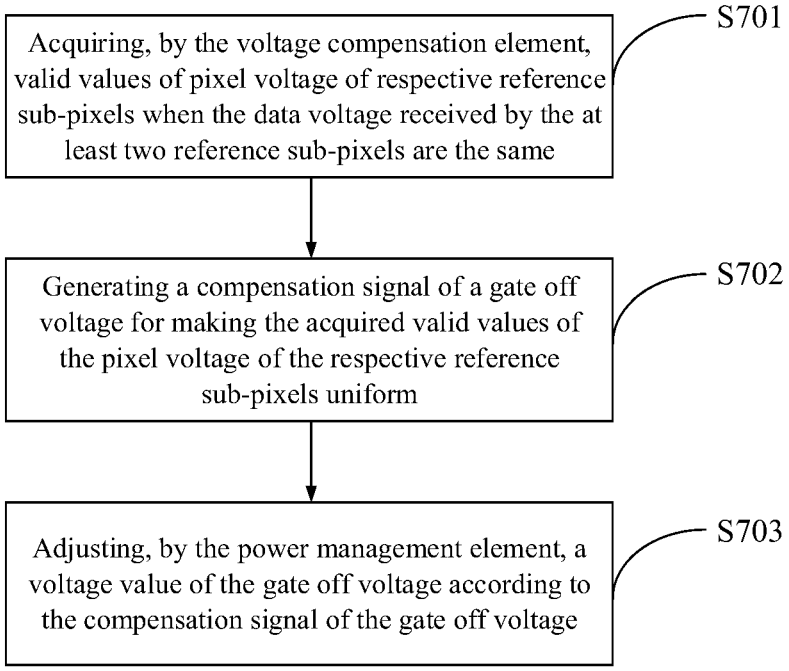
FIG. 7 is a first schematic flow chart of a voltage adjustment method according to the embodiments of the disclosure.

FIG. 7 is a flow chart of operations in a voltage adjustment method according to the embodiments of the disclosure, which can be performed by the voltage compensation element and the power management element above. As illustrated in FIG. 7, the voltage adjustment method includes the following operations.

In the operation S701, acquiring, by the voltage compensation element, valid values of pixel voltage of respective reference sub-pixels when the data voltage received by the at least two reference sub-pixels are the same.

In the operation S702, generating a compensation signal of a gate off voltage for making the acquired valid values of the pixel voltage of the respective reference sub-pixels uniform.

In the operation S703, adjusting, by the power management element, a voltage value of the gate off voltage according to the compensation signal of the gate off voltage.

In a practical implementation, generating the compensation signal of the gate off voltage for making the acquired valid values of the pixel voltage of the respective reference sub-pixels uniform includes: the analyzing sub-element outputs the compensation signal to the power management element when a difference between valid values of pixel voltage of any two of the reference sub-pixels is above a preset threshold.

Adjusting the voltage value of the gate off voltage according to the compensation signal of the gate off voltage includes: the power management element generates, in response to the compensation signal, a compensation and adjustment signal of the gate off voltage for making the valid values of the pixel voltage of the respective reference sub-pixels uniform, according to the valid values of the pixel voltage of the respective reference sub-pixels acquired by the acquiring sub-element; and adjusts the voltage value of the gate off voltage according to the compensation and adjustment signal.

Figure 8:
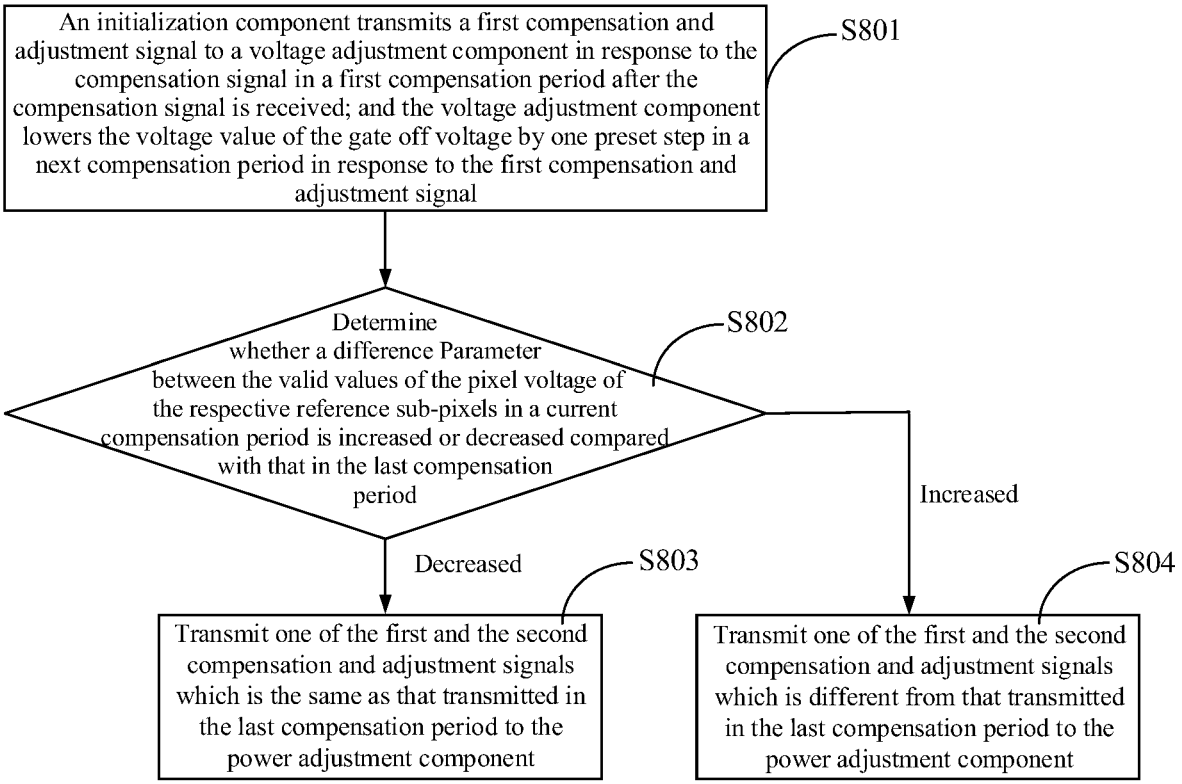
FIG. 8 is a second schematic flow chart of a voltage adjustment method according to the embodiments of the disclosure.

In a practical implementation, as illustrated in FIG. 8, generating the compensation and adjustment signal of the gate off voltage can include the following operations.

In the operation S801, an initialization component transmits a first compensation and adjustment signal to a voltage adjustment component in response to the compensation signal in a first compensation period after the compensation signal is received; and the voltage adjustment component lowers the voltage value of the gate off voltage by one preset step in a next compensation period in response to the first compensation and adjustment signal.

In the operation S802, the initialization component determines whether a difference parameter between the valid values of the pixel voltage of the respective reference sub-pixels in a current compensation period is increased or decreased compared with that in the last (i.e. the immediate previous) compensation period at an end of any other compensation period than the first compensation period, and proceeds to the operation S803 when the difference parameter is decreased, or to the operation S804 when the difference parameter is increased.

In the operation S803, the initialization component transmits one of the first and the second compensation and adjustment signals which is the same as that transmitted in the last compensation period to the power adjustment component upon determining that the difference parameter is decreased compared with that in the last compensation period, where the power adjustment component lowers the voltage value of the gate off voltage by one preset step in the next compensation period in response to the first compensation and adjustment signal, and increases the voltage value of the gate off voltage by one preset step in the next compensation period in response to the second compensation and adjustment signal.

In the operation S804, the initialization component transmits one of the first and the second compensation and adjustment signals which is different from that transmitted in the last compensation period to the power adjustment component upon determining that the difference parameter is increased compared with that in the last compensation period.

Here the first compensation and adjustment signal is configured to control the power management component to lower the output voltage value of the gate off voltage by one preset step in the next compensation period, and the second compensation and adjustment signal is configured to control the power management component to increase the output voltage value of the gate off voltage by one preset step in the next compensation period.

Figure 9:
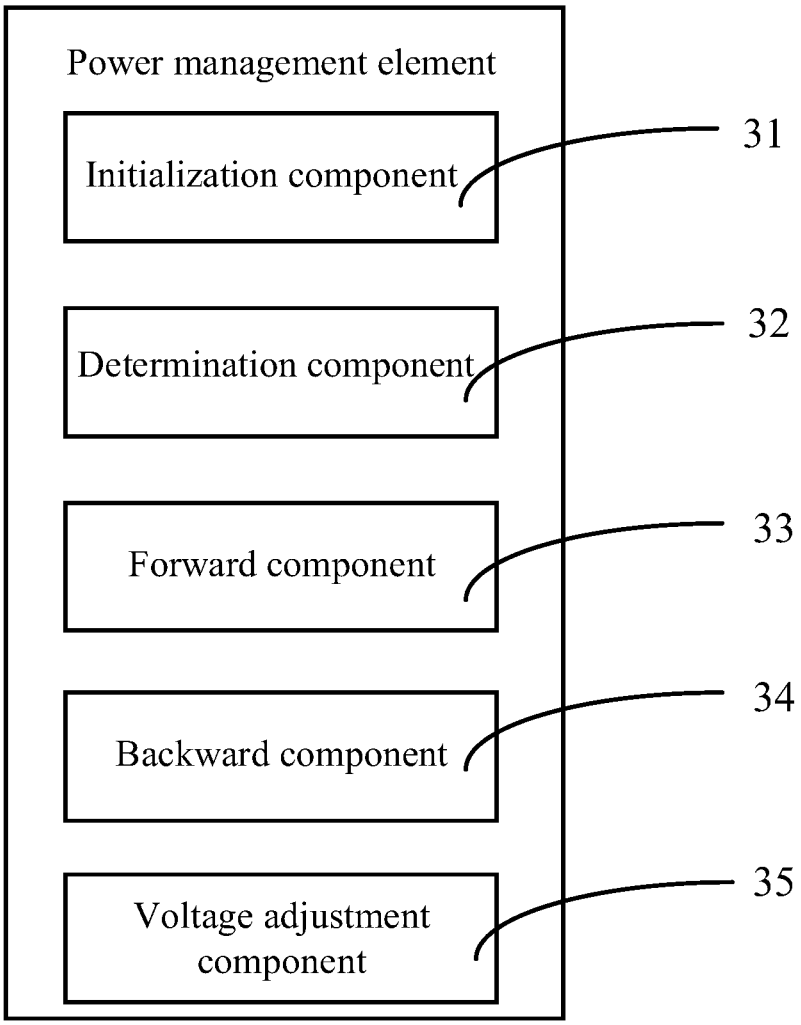
FIG. 9 is a schematic block diagram of a compensating sub-element according to the embodiments of the disclosure.

In some embodiments, as illustrated in FIG. 9, the power management element can include an initialization component 31, a determination component 32, a forward component 33, a backward component 34, and a voltage adjustment component 35.

The initialization component 31 is configured to transmit a first compensation and adjustment signal to the voltage adjustment component 35 in response to the compensation signal in a first compensation period after the compensation signal is received.

The determination component 32 is configured to determine whether a difference parameter between the valid values of the pixel voltage of the respective reference sub-pixels in the current compensation period is increased or decreased with respect to that in the last compensation period at the end of any other compensation period than the first compensation period.

The forward component 33 is configured to transmit one of the first and the second compensation and adjustment signals which is the same as that transmitted in the last compensation period to the power adjustment component 305 upon determining that the difference parameter is decreased with respect to that in the last compensation period.

The backward component 34 is configured to transmit one of the first and the second compensation and adjustment signals which is different from that transmitted in the last compensation period to the power adjustment component upon determining that the difference parameter is increased with respect to that in the last compensation period.

Where the voltage adjustment component is configured to lower the voltage value of the gate off voltage by one preset step in the next compensation period in response to the first compensation and adjustment signal, and to raise the voltage value of the gate off voltage by one preset step in the next compensation period in response to the second compensation and adjustment signal.

Figure 10:
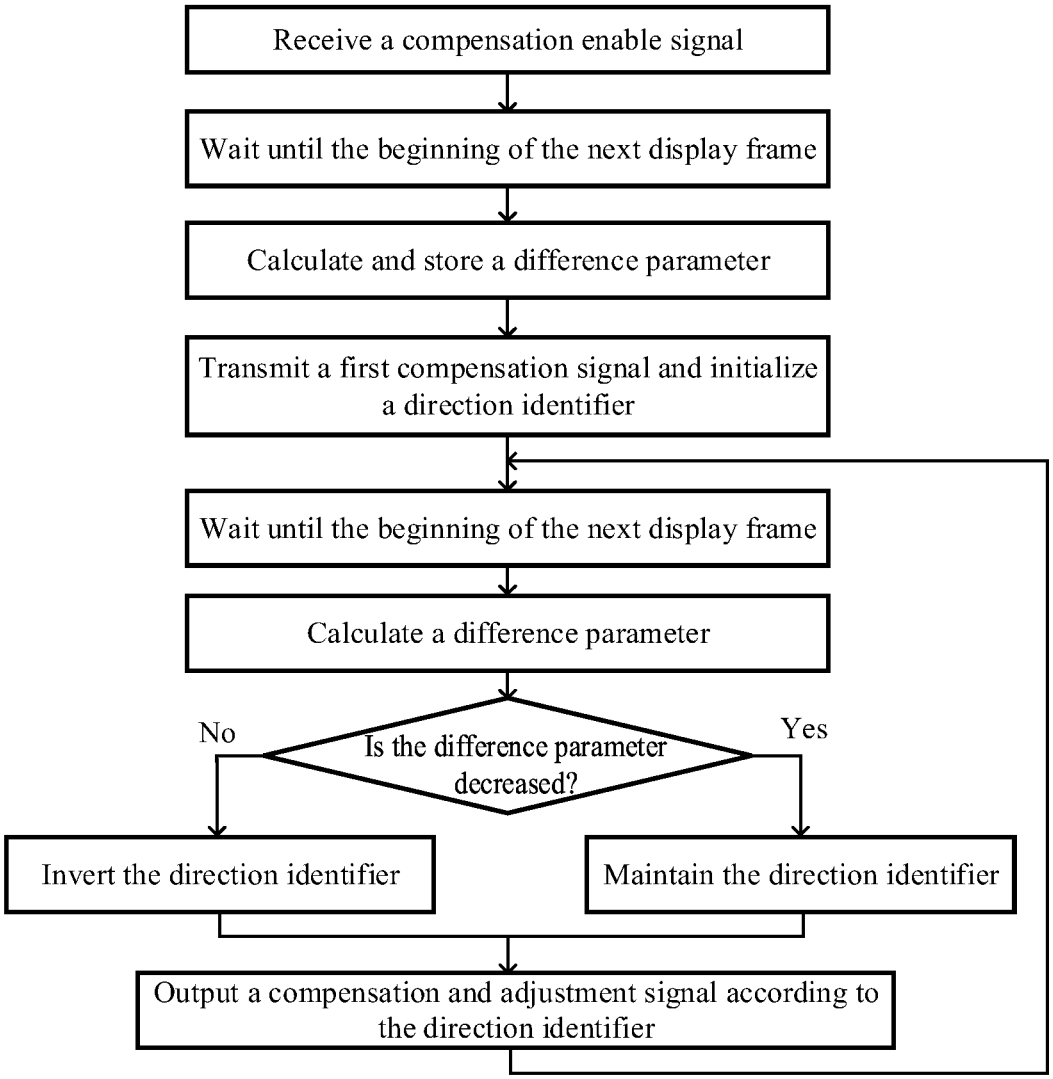
FIG. 10 is a third schematic flow chart of a voltage adjustment method according to the embodiments of the disclosure.

As illustrated in FIG. 10, a particular process of the voltage adjustment method in the embodiments of the disclosure is as follows.

In an initialization stage, when the voltage compensation element receives a compensation enable signal, the acquiring sub-element starts acquiring the valid values of the pixel voltage of the respective reference sub-pixels until the end of the current display frame, and the initialization component 31 calculates a difference parameter using the acquired valid values. In the embodiments of the disclosure, the difference parameter is a parameter configured to represent the difference between the respective valid values, and for example, can be a standard deviation of all the valid values, or a sum of absolute values of differences between every two valid values. In some embodiments, voltage values at the output terminals of the respective subtracter circuits in the analyzing sub-element can be obtained respectively, and the sum of their absolute values can be calculated as the difference parameter above, e.g., $|\Delta V1|+|\Delta V2|$. The calculated difference parameter is temporarily stored for comparison with a subsequent difference parameter. Thereafter the initialization component 31 transmits the first compensation and adjustment signal v− to the voltage adjustment component in the power management element through a signal output component, and initializes a direction identifier stored in the voltage compensation element, where the direction identifier is configured in the voltage compensation element to indicate whether the first compensation and adjustment signal v− or the second compensation and adjustment signal v+ was lastly transmitted to the power management element, and can be stored in a component, e.g., a latch, and the difference parameter can be stored in a buffer, for example, although the embodiments of the disclosure will not be limited thereto. It shall be appreciated that the first complete display frame after the voltage compensation element receives the compensation enable signal is the first compensation period above.

In a compensation stage, after the end of the first compensation period (i.e., the first frame), the process waits until the next display frame, i.e., the second compensation period (i.e., the second frame) starts, and the determination component 32 obtains the valid values of the pixel voltage of the respective reference sub-pixels in the first compensation period from the acquiring sub-element, and calculates and stores the difference parameter corresponding to the first compensation period as described above. After the end of the second compensation period (i.e., the second frame), the process waits until the third compensation period (i.e., the third frame) starts, and the determination component calculates and stores the difference parameter corresponding to the second compensation period, and compares the difference parameter corresponding to the second compensation period with the difference parameter corresponding to the first compensation period, and triggers one of the forward component 33 and the backward component 34 according to a comparison result. When the difference parameter drops, the forward component 33 transmits the first compensation and adjustment signal v− to the voltage adjustment component through the signal output component above without changing the direction identifier. When the difference parameter rises, the backward component 34 transmits the second compensation and adjustment signal v+ to the voltage adjustment component through the signal output component above after inverting the direction identifier. In each subsequent display frame, the determination component 32 calculates and compares a difference parameter to the difference parameter in the last display frame, and when the difference parameter drops, the determination component triggers the forward component 33 to continue with transmitting the same compensation and adjustment signal as that transmitted in the last display frame, and when the difference parameter rises, the determination component triggers the backward component 34 to invert the direction identifier, and to transmit a different compensation and adjustment signal from that transmitted in the last display frame.

Figure 11:
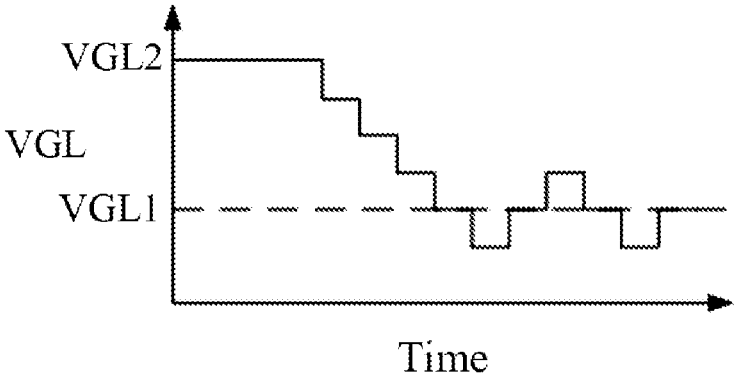
FIG. 11 is a schematic diagram of varying gate off voltage according to the embodiments of the disclosure.

In this way, if the output voltage value of the gate off voltage VGL to minimize the difference parameter is VGL1, and the output voltage value of VGL before compensation is started is VGL2 (VGL1<VGL2), then the output voltage value of VGL during compensation may vary over time as illustrated in FIG. 11, that is, the output voltage of VGL will vary in a stepped way toward the target value VGL1, and fluctuate around the target value VGL1 after reaching it in the flow above. Thereafter the voltage compensation element may keep on compensating until it cannot receive any compensation enable signal, or may stop compensating when some termination condition is satisfied, where the termination condition can be that the backward component 34 has been triggered more than four times in eight consecutive display frames, or a length of time elapsing after compensation is started has exceeded a preset length of time, although the embodiments of the disclosure will not be limited thereto.

As can be apparent, the compensation signal of the gate off voltage for making the valid values of the pixel voltage of the respective reference sub-pixels uniform can be generated in the voltage compensation process above to thereby alleviate the uniformity of brightness on the display product from dropping due to varying temperature so as to improve the quality of an image on the display product, and the reliability thereof.

In some embodiments, at least one of the initialization component 31, the determination component 32, the forward component 33, the backward component 34, and the voltage adjustment component 35 can be embodied in the form of an all-hardware embodiment, an all-software embodiment, or both. For example, the power management element 13 can be a Power Management Integrated Circuit (PMIC) in the display panel, and configured to provide required voltage for the other circuit components in the display panel, e.g., VGH and VGL. Also the power management integrated circuit can further adjust the voltage value of the gate off voltage, i.e., the voltage value of VGL, according to the compensation signal of the gate off voltage, and for example, can adjust the voltage value of VGL by the smallest magnitude of 0.1V in the range of −14V to −4V. Alternatively the function of the power management element can be performed by a voltage compensation apparatus including the initialization component 31, the determination component 32, the forward component 33, the backward component 34, and the voltage adjustment component 35. For example, the voltage compensation apparatus can include a processor, and a memory configured to store instructions executable by the processor, where the processor can execute the instructions in the memory to perform the voltage adjustment method according to any one of the embodiments above of the disclosure. Particularly the processor can be an Application Specific Integrated Circuit (ASIC), a Digital Signal Processor (DSP), a Digital Signal Processing Device (DSPD), a Programmable Logic Device (PLD), a Field Programmable Gate Array (FPGA), a controller, a micro controller, or a microprocessor, for example. The memory can be embodied as any type of volatile or nonvolatile storage device or both, e.g., a Static Random Access Memory (SRAM), an Electrically Erasable and Programmable Read Only Memory (EEPROM), an Erasable and Programmable Read Only Memory (EPROM), a Programmable Read Only Memory (PROM), a Read Only Memory (ROM), a magnetic memory, a flash memory, a magnetic disk, or an optical disc. In another embodiment, for a nonvolatile computer readable storage medium including instructions, a computer can execute the instructions stored therein to perform the voltage adjustment method according to any one of the embodiments above of the disclosure.

Figure 12:
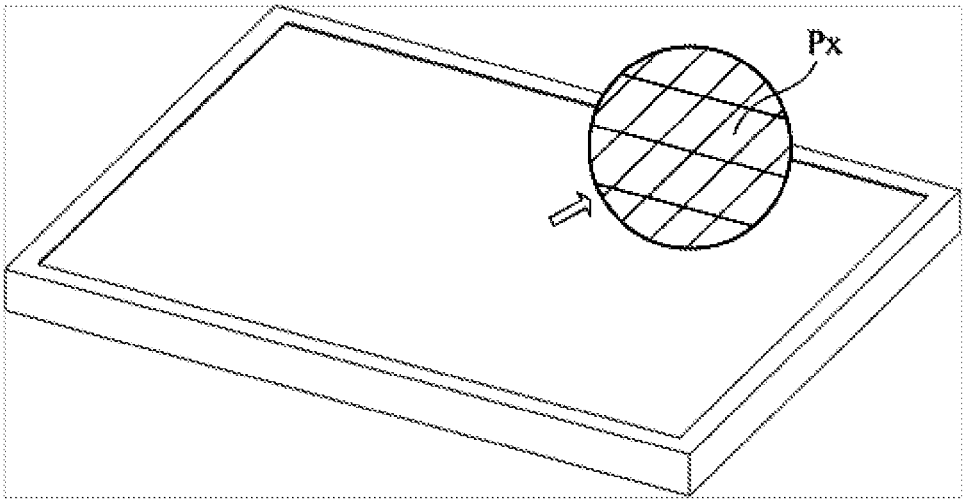
FIG. 12 is a schematic structural diagram of a display device according to the embodiments of the disclosure.

Based upon the same inventive idea, the embodiments of the disclosure provide a display device, including the display panel according to any one of the embodiments of the disclosure. The display device according to the embodiments of the disclosure can be a mobile phone, a tablet computer, a TV set, a monitor, a notebook computer, a digital photo frame, a navigator, or any other product or component with a display function. By way of an example, FIG. 12 is a schematic structural diagram of a display device according to the embodiments of the disclosure. As illustrated in FIG. 12, the display device includes sub-pixels PX arranged in rows by columns in a display area, where the sub-pixels can include reference sub-pixels configured to cooperate with a corresponding circuit structure to perform the voltage adjustment and compensation process above to thereby alleviate the uniformity of brightness on the display product from dropping due to varying temperature so as to improve the quality of an image on the display product, and the reliability thereof.

As can be apparent from the technical solutions above, with the related designs of the reference sub-pixels and the voltage compensation element, the gate off voltage can be adjusted to make the brightness of the respective sub-pixels uniform in the embodiments of the disclosure, so that the uniform of brightness can be compensated for as a whole instead of traditional temperature measurement compensation to thereby alleviate the uniformity of brightness on the display product from dropping due to varying temperature so as to improve the quality of an image on the display product, and the reliability thereof.

It shall be noted that only the structures for setting forth the technical solutions of the disclosure have been illustrated in the drawings for the sake of clarity, but one or more of the components of the real product can be added, deleted, or modified with reference to the drawings without departing from the scope of the disclosure. The foregoing description is only illustrative of the preferable embodiments of the disclosure, but not intended to limit the disclosure thereto, and any modifications, substitutions, adaptations, made thereto without departing from the spirit and principle of the disclosure shall fall into the claimed scope of the disclosure.

The invention claimed is:

1. A display panel, comprising:

at least two reference sub-pixels;

a voltage compensation element coupled respectively with the at least two reference sub-pixels; and a power management element coupled with the voltage compensation element, wherein:

the voltage compensation element is configured to acquire valid values of pixel voltage of respective reference sub-pixels when data voltage received by the at least two reference sub-pixels are same, and to generate a compensation signal of gate off voltage for a purpose of making the acquired valid values of the pixel voltage of the respective reference sub-pixels uniform; and the power management element is configured to adjust a voltage value of the gate off voltage according to the compensation signal of the gate off voltage;

wherein the voltage compensation element comprises an acquiring sub-element and an analyzing sub-element, wherein:

the acquiring sub-element is configured to acquire the valid values of the pixel voltage of the respective reference sub-pixels;

the analyzing sub-element is configured to output the compensation signal to the power management element when a difference between valid values of pixel voltage of any two reference sub-pixels is above a preset threshold; and the power management element is configured to generate, according to the valid values of the pixel voltage of the respective reference sub-pixels acquired by the acquiring sub-element, a compensation and adjustment signal of the gate off voltage for making the valid values of the pixel voltage of the respective reference sub-pixels uniform in response to the compensation signal, and to adjust the voltage value of the gate off voltage according to the compensation and adjustment signal;

wherein the analyzing sub-element comprises an OR gate circuit and at least one subtracter circuit, wherein:

each of the at least one subtracter circuit has a first input terminal configured to receive a valid value of pixel voltage of one reference sub-pixel, a second input terminal configured to receive a valid value of pixel voltage of another reference sub-pixel, and an output terminal coupled with a first input terminal of the OR gate circuit; and the OR gate circuit has an output terminal coupled with the power management element, and configured to output the compensation signal; and the preset threshold is a voltage value at a valid level of the OR gate circuit.

2. The display panel according to claim 1, wherein the display panel further comprises a timing controller connected with the voltage compensation element, where the timing controller is configured to transmit a compensation enable signal to the voltage compensation element upon detecting that the data voltage received by the at least two reference sub-pixels are the same; and the voltage compensation element is configured to acquire the valid values of the pixel voltage of the respective reference sub-pixels in response to the compensation enable signal.

3. The display panel according to claim 2, wherein the respective reference sub-pixels comprise pixel electrodes, and the display panel further comprises connection lines corresponding to the respective reference sub-pixels in a one-to-one manner; and the pixel electrodes in the respective reference sub-pixels are coupled with the voltage compensation element through their corresponding connection lines.

4. The display panel according to claim 2, wherein the valid values of the pixel voltage of the respective reference sub-pixels are root mean squares of the pixel voltage of the respective reference sub-pixels in a display frame.

5. The display panel according to claim 1, wherein the power management element comprises an initialization component, a determination component, a forward component, a backward component, and a voltage adjustment component, wherein:

the initialization component is configured to transmit a first compensation and adjustment signal to the voltage adjustment component in response to the compensation signal in a first compensation period after the compensation signal is received;

the determination component is configured to determine whether a difference parameter between the valid values of the pixel voltage of the respective reference sub-pixels in a current compensation period is increased or decreased with respect to that in a last compensation period at an end of any other compensation period than the first compensation period;

the forward component is configured to transmit one of the first compensation and adjustment signal and a second compensation and adjustment signal, which is the same as that transmitted in the last compensation period, to the power adjustment component upon determining that the difference parameter is decreased with respect to that in the last compensation period;

the backward component is configured to transmit one of the first compensation and adjustment signal and the second compensation and adjustment signal, which is different from that transmitted in the last compensation period, to the power adjustment component upon determining that the difference parameter is increased with respect to that in the last compensation period; and the voltage adjustment component is configured to lower the voltage value of the gate off voltage by one preset step in a next compensation period in response to the first compensation and adjustment signal, and to increase the voltage value of the gate off voltage by one preset step in a next compensation period in response to the second compensation and adjustment signal.

6. The display panel according to claim 5, wherein each compensation period is a display frame.

7. The display panel according to claim 1, wherein the at least two reference sub-pixels are located in a same column.

8. The display panel according to claim 7, wherein the at least two reference sub-pixels comprise a first reference sub-pixel, a second reference sub-pixel, and a third reference sub-pixel, wherein:

the first reference sub-pixel and the third reference sub-pixel are located respectively at edges of a display area on two opposite sides thereof, and the second reference sub-pixel is located between the first reference sub-pixel and the third reference sub-pixel at equal distances from them.

9. The display panel according to claim 1, wherein the respective reference sub-pixels comprise pixel electrodes, and the display panel further comprises connection lines corresponding to the respective reference sub-pixels in a one-to-one manner; and the pixel electrodes in the respective reference sub-pixels are coupled with the voltage compensation element through their corresponding connection lines.

10. The display panel according to claim 9, wherein polarities of pixel voltage of sub-pixels in two adjacent display frames are opposite.

11. The display panel according to claim 1, wherein the valid values of the pixel voltage of the respective reference sub-pixels are root mean squares of the pixel voltage of the respective reference sub-pixels in a display frame.

12. A display device, comprising the display panel according to claim 1.

13. The display panel according to claim 1, wherein the respective reference sub-pixels comprise pixel electrodes, and the display panel further comprises connection lines corresponding to the respective reference sub-pixels in a one-to-one manner; and the pixel electrodes in the respective reference sub-pixels are coupled with the voltage compensation element through their corresponding connection lines.

14. The display panel according to claim 1, wherein the valid values of the pixel voltage of the respective reference sub-pixels are root mean squares of the pixel voltage of the respective reference sub-pixels in a display frame.

15. A voltage adjustment method of a display panel, wherein the display panel comprises:

at least two reference sub-pixels;

a voltage compensation element coupled respectively with the at least two reference sub-pixels; and a power management element coupled with the voltage compensation element, wherein:

the voltage compensation element is configured to acquire valid values of pixel voltage of respective reference sub-pixels when data voltage received by the at least two reference sub-pixels are same, and to generate a compensation signal of gate off voltage for a purpose of making the acquired valid values of the pixel voltage of the respective reference sub-pixels uniform; and the power management element is configured to adjust a voltage value of the gate off voltage according to the compensation signal of the gate off voltage;

wherein the voltage compensation element comprises an acquiring sub-element and an analyzing sub-element, wherein:

the acquiring sub-element is configured to acquire the valid values of the pixel voltage of the respective reference sub-pixels;

the analyzing sub-element is configured to output the compensation signal to the power management element when a difference between valid values of pixel voltage of any two reference sub-pixels is above a preset threshold; and the power management element is configured to generate, according to the valid values of the pixel voltage of the respective reference sub-pixels acquired by the acquiring sub-element, a compensation and adjustment signal of the gate off voltage for making the valid values of the pixel voltage of the respective reference sub-pixels uniform in response to the compensation signal, and to adjust the voltage value of the gate off voltage according to the compensation and adjustment signal;

wherein the analyzing sub-element comprises an OR gate circuit and at least one subtracter circuit, wherein:

each of the at least one subtracter circuit has a first input terminal configured to receive a valid value of pixel voltage of one reference sub-pixel, a second input terminal configured to receive a valid value of pixel voltage of another reference sub-pixel, and an output terminal coupled with a first input terminal of the OR gate circuit; and the OR gate circuit has an output terminal coupled with the power management element, and configured to output the compensation signal; and the preset threshold is a voltage value at a valid level of the OR gate circuit;

wherein the method comprises:

acquiring, by the voltage compensation element, the valid values of the pixel voltage of the respective reference sub-pixels when the data voltage received by the at least two reference sub-pixels are the same;

generating, by the voltage compensation element, the compensation signal of the gate off voltage for making the acquired valid values of the pixel voltage of the respective reference sub-pixels uniform; and adjusting, by the power management element, the voltage value of the gate off voltage according to the compensation signal of the gate off voltage;

wherein generating the compensation signal of the gate off voltage for making the acquired valid values of the pixel voltage of the respective reference sub-pixels uniform comprises:

outputting, by an analyzing sub-element, the compensation signal to the power management element when a difference between valid values of pixel voltage of any two of the reference sub-pixels is above a preset threshold; and adjusting the voltage value of the gate off voltage according to the compensation signal of the gate off voltage comprises:

generating, by the power management element, according to the valid values of the pixel voltage of the respective reference sub-pixels acquired by the acquiring sub-element, a compensation and adjustment signal of the gate off voltage for making the valid values of the pixel voltage of the respective reference sub-pixels uniform, in response to the compensation signal; and adjusting the voltage value of the gate off voltage according to the compensation and adjustment signal;

wherein generating the compensation and adjustment signal of the gate off voltage comprise:

transmitting, by an initialization component, a first compensation and adjustment signal to a voltage adjustment component in response to the compensation signal in a first compensation period after the compensation signal is received, and lowering, by the voltage adjustment component, the voltage value of the gate off voltage by one preset step in a next compensation period in response to the first compensation and adjustment signal;

determining whether a difference parameter between the valid values of the pixel voltage of the respective reference sub-pixels in a current compensation period is increased or decreased with respect to that in a last compensation period at an end of any other compensation period than the first compensation period;

transmitting one of the first compensation and adjustment signal and a second compensation and adjustment signal, which is the same as that transmitted in the last compensation period, to the power adjustment component upon determining that the difference parameter is decreased with respect to that in the last compensation period, wherein the power adjustment component lowers the voltage value of the gate off voltage by one preset step in the next compensation period in response to the first compensation and adjustment signal, and increases the voltage value of the gate off voltage by one preset step in the next compensation period in response to the second compensation and adjustment signal; and transmitting one of the first compensation and adjustment signal and the second compensation and adjustment signal, which is different from that transmitted in the last compensation period, to the power adjustment component upon determining that the difference parameter is increased with respect to that in the last compensation period.

* * * * *